US010195856B2

(12) United States Patent
Quintero Ruiz et al.

(10) Patent No.: US 10,195,856 B2
(45) Date of Patent: Feb. 5, 2019

(54) PRINTHEAD CARRIAGE

(71) Applicant: HEWLETT-PACKARD DEVELOPMENT COMPANY, L.P., Houston, TX (US)

(72) Inventors: Xavier Quintero Ruiz, San Cugat del Valles (ES); Luis Garcia-Maurino, San Cugat del Valles (ES); Mireia Garcia, Sant Cugat del Valles (ES); Carmen Blasco, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/539,333

(22) PCT Filed: Jan. 15, 2015

(86) PCT No.: PCT/US2015/011511
§ 371 (c)(1),
(2) Date: Jun. 23, 2017

(87) PCT Pub. No.: WO2016/114778
PCT Pub. Date: Jul. 21, 2016

(65) Prior Publication Data

US 2017/0348974 A1 Dec. 7, 2017

(51) Int. Cl.

| | |
|---|---|
| ***B41J 2/165*** | (2006.01) |
| ***B41J 2/175*** | (2006.01) |
| ***B41J 19/14*** | (2006.01) |
| ***B41J 2/15*** | (2006.01) |
| ***B41J 2/17*** | (2006.01) |
| ***B41J 2/045*** | (2006.01) |
| *B41J 2/14* | (2006.01) |

(52) U.S. Cl.
CPC ..... *B41J 2/16526* (2013.01); *B41J 2/04503* (2013.01); *B41J 2/15* (2013.01); *B41J 2/175* (2013.01); *B41J 2/1714* (2013.01); *B41J 19/142* (2013.01); *B41J 2/14* (2013.01); *B41J 2002/14306* (2013.01)

(58) Field of Classification Search
CPC .... B41J 2/16526; B41J 2/04503; B41J 2/175; B41J 2/14; B41J 2002/14306; B41J 2/09; B41J 2/07
See application file for complete search history.

(56) References Cited

U.S. PATENT DOCUMENTS

| | | | | |
|---|---|---|---|---|
| 6,561,620 | B2 * | 5/2003 | Pietrzyk | B41J 2/2132 347/34 |
| 6,565,182 | B1 | 5/2003 | Fredrickson et al. | |
| 8,562,106 | B2 | 10/2013 | Sakata et al. | |
| 8,651,632 | B2 | 2/2014 | Marcus et al. | |
| 2011/0249060 | A1 * | 10/2011 | Sakata | B41J 2/1714 347/37 |

(Continued)

FOREIGN PATENT DOCUMENTS

| | | | | |
|---|---|---|---|---|
| JP | 2004042580 | * | 2/2004 | B41J 2/01 |
| JP | 2004042580 | A | 2/2004 | |

(Continued)

*Primary Examiner* — Henok Legesse
(74) *Attorney, Agent, or Firm* — HP Inc. Patent Department

(57) ABSTRACT

In one example, a wedge shaped carriage to carry a printhead back and forth over a print substrate during printing.

9 Claims, 3 Drawing Sheets

(56) References Cited

U.S. PATENT DOCUMENTS

2011/0285770 A1* 11/2011 Kobayashi ..... B41J 2/14
347/9

FOREIGN PATENT DOCUMENTS

| | | | |
|---|---|---|---|
| JP | 2004306270 | A | 11/2004 |
| JP | 2006315226 | A | 11/2006 |
| WO | WO-2014024810 | A1 | 2/2014 |

* cited by examiner

PRINTHEAD CARRIAGE

BACKGROUND

Inkjet printers utilize printheads that include tiny nozzles through which ink is dispensed on to paper or another print substrate. In one type inkjet printer, the printheads are carried on a carriage that is scanned back and forth over the print substrate as the printheads dispense printing fluid through the nozzles on to the substrate.

DRAWINGS

The same part numbers are used to designate the same or similar parts throughout the figures.

DESCRIPTION

For scanning type inkjet printers, the combination of higher carriage speeds and closer printhead-to-substrate spacing can cause air flows that adversely affect the placement of ink drops dispensed from the printheads on to the print substrate, menacing the use of higher speed carriages and smaller ink drops. A blunt, high speed carriage can generate excessively high pressure at a leading part of the carriage and excessively low pressure at a trailing part of the carriage. Excessive high and low pressures cause high volume, turbulent air flows under the carriage that trap and displace smaller ink drops, degrading print quality.

A new printhead carriage has been developed to help moderate air pressure at the leading and trailing parts of the carriage, thus lowering air flow and turbulence in the print zone under the carriage. In one example, a wedge shaped carriage deflects much of the oncoming air sharply over the carriage to inhibit the formation of an undesirably high pressure region at the leading part of the carriage. The trailing part of the carriage may also be tapered to inhibit the formation of an undesirably low pressure region behind the carriage. For printers that dispense printing fluid while the carriage is moving in both directions, back and forth over the print substrate, each side of the carriage may be wedge shaped to present tapered leading and trailing parts for printing in both directions.

These and other examples shown in the figures and described herein illustrate but do not limit the scope of the claim subject matter. Other examples are possible. Therefore, the foregoing description should not be construed to limit the scope of the patent, which is defined in the claims following this Description.

As used in this document, a "printhead" means that part of an inkjet printer or other inkjet type dispenser that dispenses fluid, for example as drops or streams. A "printhead" is not limited to printing with ink but also includes inkjet type dispensing of other fluid and/or for uses other than printing.

Figure 1:
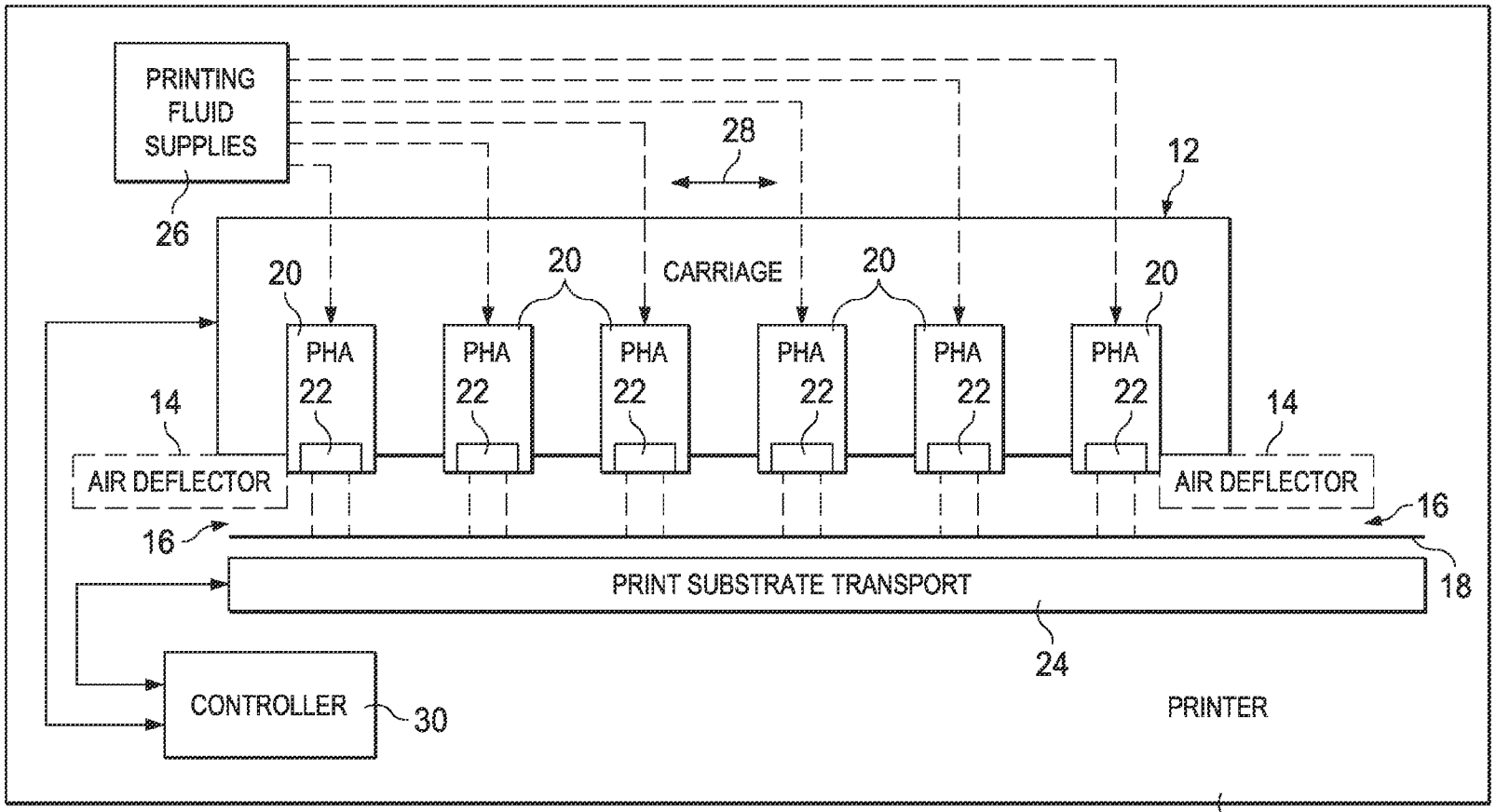
FIG. 1 is a block diagram illustrating a scanning type inkjet printer implementing one example of a carriage that includes a deflector to inhibit the flow of oncoming air through the print zone under the carriage.

FIG. 1 is a block diagram illustrating an inkjet printer 10 implementing one example of a carriage 12 with deflectors 14 spanning the print zone 16 to deflect oncoming air over carriage 12 when carriage 12 is moving back and forth over a print substrate 18. FIGS. 2-7 illustrate examples of a carriage 12 with deflectors 14 such as might be used in printer 10 shown in FIG. 1. Referring first to FIG. 1, printer 10 includes carriage 12 carrying printhead assemblies (PHA) 20 each with one or multiple printheads 22. A printhead assembly 20 in an inkjet printer is also commonly referred to as an ink pen, a print cartridge or an ink cartridge. A transport mechanism 24 advances a paper or other print substrate 18 past carriage 12 and printhead assembles 20. Printhead assemblies 20 are operatively connected to ink or other printing fluid supplies 26. Although remote supplies 26 are shown, the printing fluid supplies 26 could be located on carriage 12, for example with each printhead assembly 20 having an internal supply of printing fluid. A controller 30 is operatively connected to carriage 12, printhead assemblies 20 and substrate transport 24. Controller 30 represents the program instructions, processor and associated memory, and the electronic circuitry and components needed to control the operative elements of printer 10. Controller 30 is electrically connected to each printhead 22 to selectively energize fluid dispensing elements for dispensing printing fluid on to substrate 18. By coordinating the relative position of carriage 12 and substrate 18 with dispensing printing fluid from printheads 22, controller 30 controls printing the desired image on substrate 18.

Carriage 12 is configured to deflect oncoming air smoothly over the carriage, away from print zone 16 under carriage 12. A "print zone" as used in this document means the region under the carriage during printing. Print zone 16 in FIG. 1 moves with carriage 12. Direction arrow 28 in FIG. 1 indicates the movement of carriage 12 back and forth over print substrate 18. Each end of carriage 12 will be the upstream, leading part of carriage 12 at any given time during printing, depending on the direction carriage 12 is moving. Thus, an air deflector 14 is shown on each end of carriage 12. While printer 10 in FIG. 1 can dispense printing fluid while carriage 12 is moving in both directions back and forth over substrate 18, examples of a carriage 12 with a single deflector 14 may be implemented in printers that dispense printing fluid while moving in only one direction over substrate 18.

Figure 2:
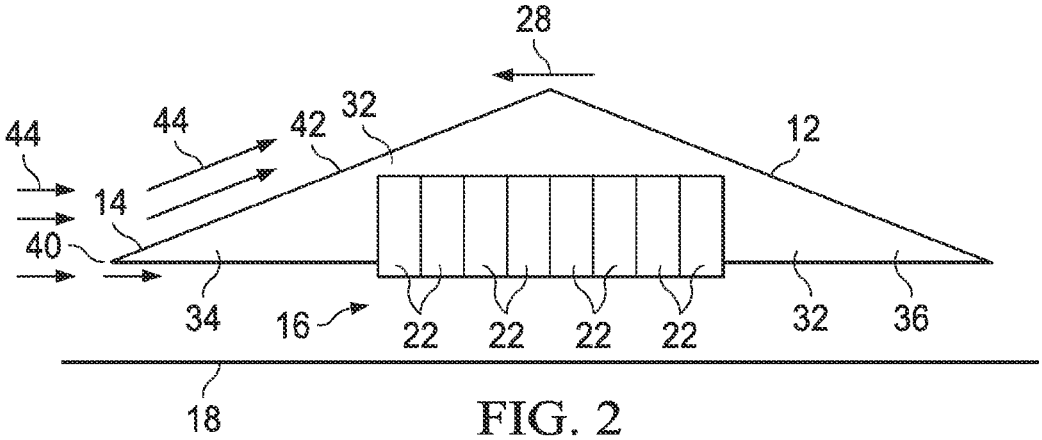
FIGS. 2-4 illustrate one example of a wedge shaped carriage to deflect oncoming air sharply over the carriage away from the print zone, such as might be implemented in the printer shown in FIG. 1.
Figure 3:
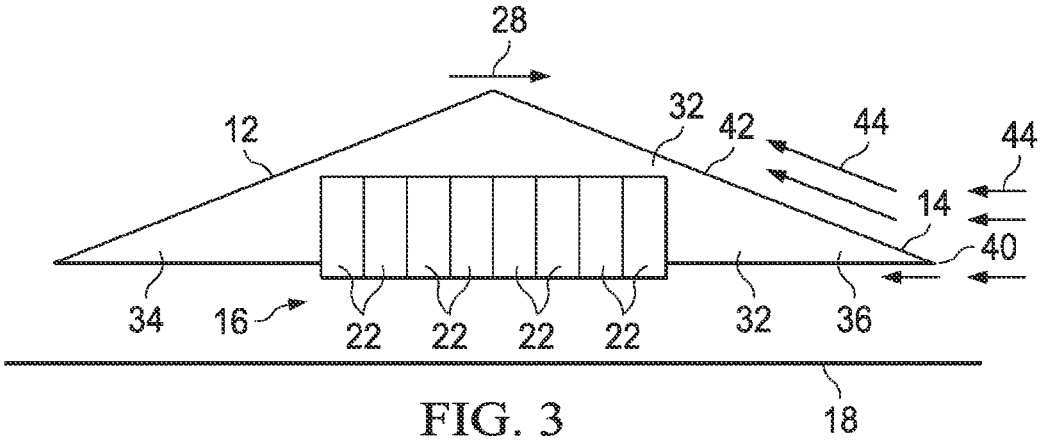
Figure 4:
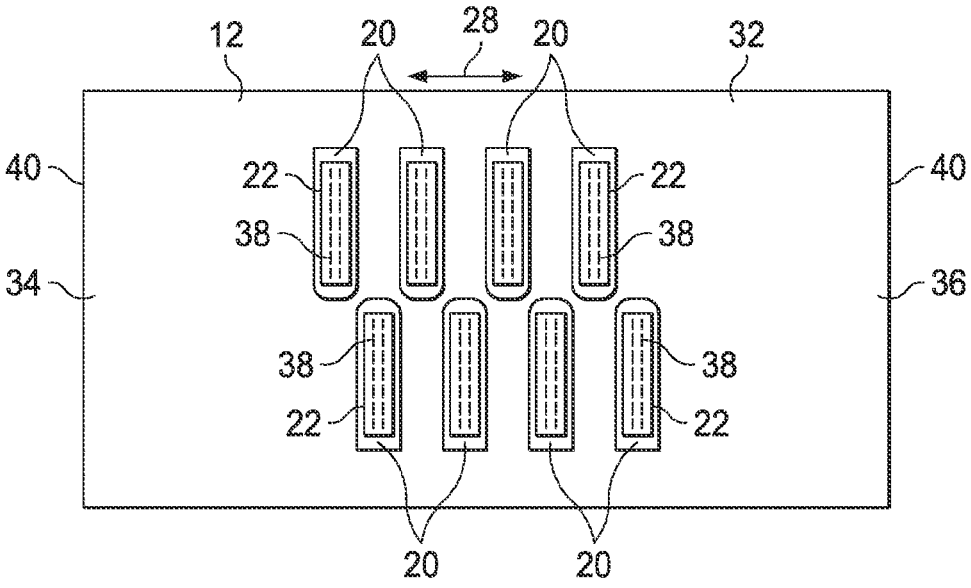

FIGS. 2-4 are side elevation and bottom plan views illustrating one example of a carriage 12 with air deflectors 14. FIG. 2 shows carriage 12 moving to the left and FIG. 3 shows carriage 12 moving to the right. Referring to FIGS. 2-4, carriage 12 includes an inboard part 32 that holds printhead assemblies 20 and outboard parts 34, 36 with deflectors 14. Each printhead assembly 20 includes a printhead 22 with fluid dispensing nozzles 38 exposed through the bottom of carriage 12 to dispense printing fluid on to substrate 18 during printing. When carriage 12 is moving to the left, as shown in FIG. 2, outboard part 34 is the upstream, leading part of carriage 12 and outboard part 36 is the downstream, trailing part of carriage 12. When carriage 12 is moving to the right, as shown in FIG. 3, outboard part 36 is the upstream, leading part of carriage 12 and outboard part 34 is the downstream, trailing part of carriage 12.

Each outboard part 34, 36 is wedge shaped to form a deflector 14 with a sharp leading edge 40 and a tapered flow surface 42 spanning the full extent of the exposed fluid dispensing nozzles 38. A wedge shaped deflector 14 at the leading part of carriage 12 cuts the oncoming air 44 sharply and deflects much of it smoothly over carriage 12 to minimize air flow under through print zone 16 under carriage 12 and to inhibit the formation of a high pressure region at the front of carriage 12. A wedge shaped outboard part 34, 36 with a tapered surface 42 also inhibits the formation of a low pressure region behind carriage 12. In the example shown, rectilinear flow surfaces 42 extend continuously over printheads 22 (in the direction of carriage movement) to help reduce drag forces and minimize unwanted air circulation among the printheads.

Figure 5:
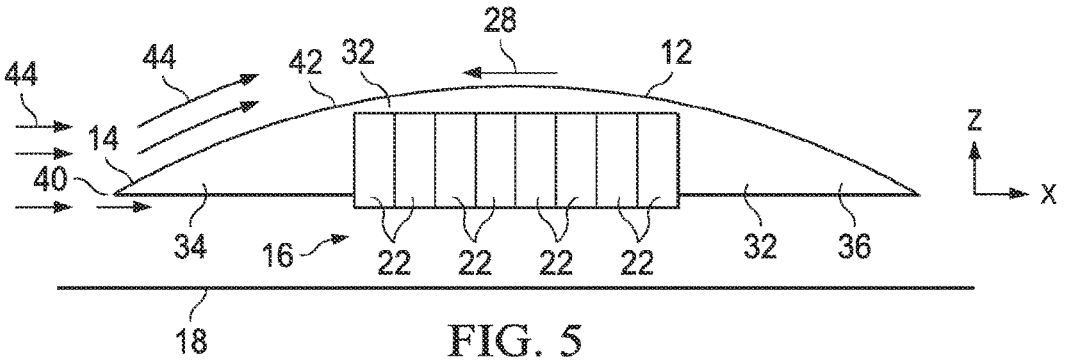
FIGS. 5-7 illustrate another example of a wedge shaped carriage to deflect oncoming air sharply over the carriage away from the print zone, such as might be implemented in the printer shown in FIG. 1.
Figure 6:
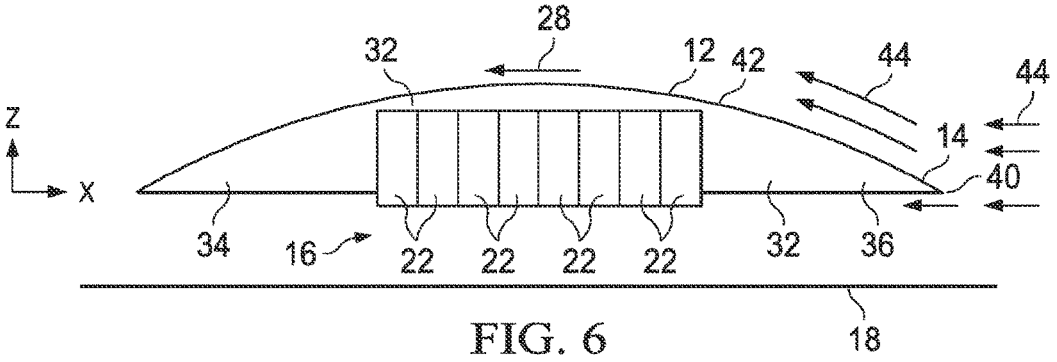
Figure 7:
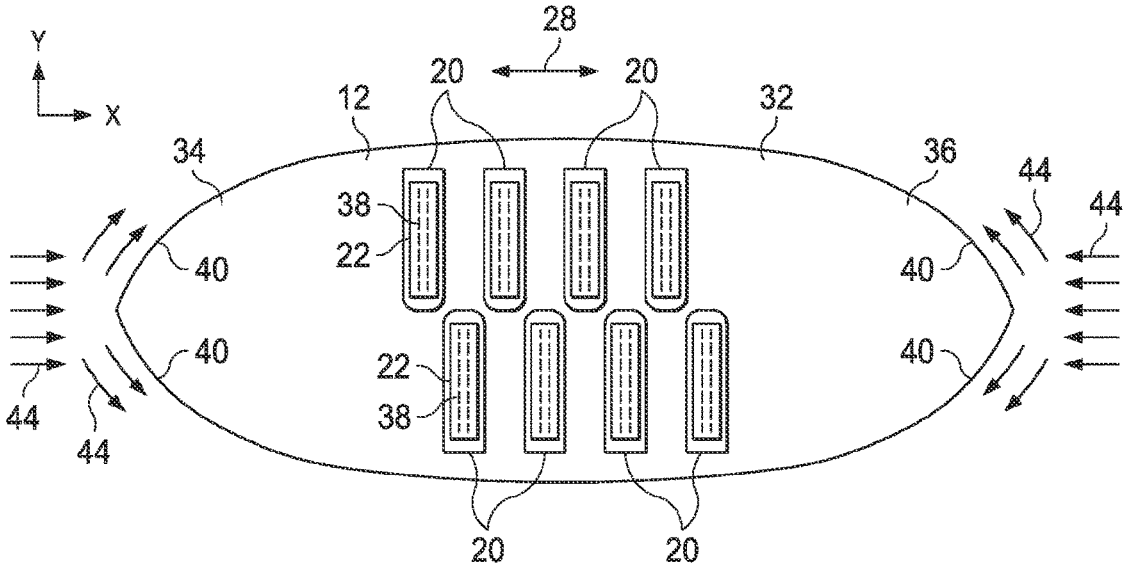

FIGS. 5-7 illustrate another example of a carriage 12 with air deflectors 14. FIG. 5 shows carriage 12 moving to the left and FIG. 6 shows carriage 12 moving to the right. In the example shown in FIGS. 5-7, each deflector 14 is configured to deflect oncoming air 44 simultaneously over and around carriage 12, adjusting the air flow in the X-Y place as well as in the X-Z plane. Thus, each outboard part 34, 36 is wedge shaped vertically, in the X-Z plane as shown in FIGS. 5 and 6, and horizontally, in the X-Y plane as shown in FIG. 7. Also, in this example, curvilinear flow surfaces 42 cover printheads 22 to help improve the aerodynamics of carriage 12.

As noted at the beginning of this Description, the examples shown in the figures and described above illustrate but do not limit the scope of the claimed subject matter. Other examples are possible. Therefore, the foregoing description should not be construed to limit the scope of the patent, which is defined in the following claims.

What is claimed is:

1. A carriage to carry an ink cartridge that includes a printhead back and forth during printing, the carriage comprising wedge shaped leading parts to direct oncoming air over a top surface of the carriage and away from a print zone under the carriage and to not direct oncoming air toward the print zone under the carriage, when the carriage is moving back and forth over the print substrate.

2. The carriage of claim 1, comprising a tapered trailing part opposite each leading part.

3. The carriage of claim 2, where:

a first one of the leading parts is to direct oncoming air over the top surface of the carriage and away from the print zone when the carriage is moving in a first direction and a second one of the leading parts is to direct oncoming air over the top surface of the carriage and away from the print zone when the carriage is moving in a second direction opposite the first direction; and the first leading part forms a first one of the trailing parts when the carriage is moving in the second direction and the second leading part forms a second one of the trailing parts when the carriage is moving in the first direction.

4. The carriage of claim 3, where the top surface of the carriage comprises a sloped exterior flow surface that extends continuously from the first leading part and the second leading part.

5. A movable carriage to carry an ink cartridge that includes a printhead back and forth during printing, the carriage comprising an exterior surface having a horizontal bottom part surrounding an exposed part of the cartridge when the cartridge is carried by the carriage during printing and a first sloped top part and a second sloped top part covering the cartridge when the cartridge is carried by the carriage during printing, the first sloped top part intersecting the bottom part along a sharp first edge and the second sloped top part intersecting the bottom part along a sharp second edge opposite the first edge in a direction the carriage moves back and forth during printing, such that when the carriage is moving in a first direction the first edge forms a leading edge of the carriage and the second edge forms a trailing edge of the carriage and when the carriage is moving in a second direction opposite the first direction the second edge forms the leading edge of the carriage and the first edge forms the trailing edge of the carriage, and the first sloped top part intersecting the second sloped top part at a single point such that the first and second sloped top parts together extend continuously between the first edge and the second edge.

6. The carriage of claim 5, where the first edge and the second edge are the same shape.

7. The carriage of claim 6, where the first and second sloped top parts are symmetrical about a vertical plane through the point of intersection between the first edge and the second edge.

8. The carriage of claim 7, where the first and second sloped top parts are curvilinear.

9. The carriage of claim 7, where the first and second sloped top parts are rectilinear.

* * * * *